US007316053B2

(12) United States Patent
Dennis et al.

(10) Patent No.: US 7,316,053 B2
(45) Date of Patent: Jan. 8, 2008

(54) MEMORIALIZATION CASKET

(75) Inventors: Todd K. Dennis, Batesville, IN (US); Jon E. Doyle, Batesville, IN (US); Thomas F. Heil, Batesville, IN (US); Paul A. Holzman, Mason, OH (US); Christopher R. Ruberg, Batesville, IN (US)

(73) Assignee: Batesville Services, Inc., Batesville, IN ( * ) Notice: Subject to any disclaimer, the term of this patent is extended or adjusted under 35 U.S.C. 154(b) by 0 days.

(21) Appl. No.: 10/687,132

(22) Filed: Oct. 16, 2003

(65) Prior Publication Data

US 2005/0108864 A1 May 26, 2005

(51) Int. Cl.
*A61G 17/00* (2006.01)

(52) U.S. Cl. ..... 27/2; 27/4

(58) Field of Classification Search ..... 27/14, 27/19, 2, 4; D99/1, 2, 8, 9
See application file for complete search history.

(56) References Cited

U.S. PATENT DOCUMENTS

| | | | |
|---|---|---|---|
| 443,209 | A | 12/1890 | Ripsom |
| 458,527 | A | 8/1891 | Fresht |
| 494,297 | A | 3/1893 | Leonhardt |
| 504,009 | A | 8/1893 | Whitney |
| 545,176 | A | 8/1895 | Ruebekam |
| 2,159,144 | A | 5/1939 | Fletcher |
| 2,526,793 | A | 10/1950 | Alfred |
| 2,604,369 | A | 7/1952 | Phillips et al. |
| 4,177,543 | A | 12/1979 | Angermann |
| 4,457,054 | A | 7/1984 | Craft et al. |
| 4,788,757 | A | 12/1988 | Bethune et al. |
| 5,481,785 | A | 1/1996 | Minton et al. |
| 5,562,049 | A | 10/1996 | Hoffman et al. |
| 5,611,124 | A | 3/1997 | Biondo et al. |
| 5,675,876 | A | 10/1997 | Benedict et al. |
| 5,678,289 | A | 10/1997 | Saaf |
| 5,727,291 | A | 3/1998 | Biondo et al. |
| 5,749,554 | A | 5/1998 | Avila et al. |
| 5,771,814 | A | 6/1998 | Clausen |
| 5,956,825 | A | 9/1999 | McCoy et al. |
| 6,322,123 | B1 | 11/2001 | Garrison et al. |
| 6,324,736 | B1 | 12/2001 | Atrio |
| 6,324,737 | B1 | 12/2001 | Chamness et al. |

*Primary Examiner*—William L. Miller
(74) *Attorney, Agent, or Firm*—Wood, Herron & Evans LLP

(57) ABSTRACT

A casket comprises a casket shell, a casket lid close able upon the shell and deployable structure, operably associated with either the shell or the lid, and integrally formed therewith, which, when deployed, defines a memorial surface adapted to have placed thereon items of memorialization for display. The deployable structure is so configured and arranged such that the items of memorialization must be removed therefrom when the structure is not deployed. In one aspect, the deployable structure can be operably associated with said shell. In another aspect, the deployable structure can be operably associated with the lid.

3 Claims, 17 Drawing Sheets

MEMORIALIZATION CASKET

FIELD OF THE INVENTION

This invention relates generally to the death care industry, and more particularly to personalized caskets for memorializing a deceased.

BACKGROUND OF THE INVENTION

There is a trend in the death care industry to make efforts towards "personalizing" the funeral products and the funeral or other memorial service purchased for the deceased to provide a more meaningful memorial experience for the family and friends of the deceased. One of the earlier attempts at providing a means of personalizing or customizing a casket to the deceased may be seen with reference to the Assignee's U.S. Pat. No. 4,457,054 titled Casket Shelf, hereby incorporated by reference herein. That patent discloses a casket shelf which is mounted to the dish assembly of the head end cap when the head end cap is in the open position. The shelf provides a surface for supporting and displaying articles of religious or personal significance to the deceased when the head end cap is open during viewing of the deceased. The shelf is removed from the dish assembly when the head end cap is closed, i.e. the shelf is not integrally formed as a part of the casket.

More recently, caskets have been provided with memorabilia drawers in which keepsakes of the deceased can not only be displayed, but can be stored as well, as disclosed in the Assignee's U.S. Pat. Nos. 5,611,124 and 5,727,291, both titled Casket Having Memorabilia Compartment and hereby incorporated by reference herein. In these patents the items of memorabilia in the drawer can be displayed when the head end cap is open during viewing of the deceased by withdrawing the drawer from the foot end cap, and can be stored by inserting the drawer into the foot end cap. The caskets of these patents are commercially available from the assignee as the MemorySafe® line of caskets.

Caskets have also been provided with memorabilia trays that pivot into and out of the casket shell in which keepsakes of the deceased can be displayed when the tray is pivoted out of the casket shell and stored when the tray is pivoted into the casket shell, as disclosed in the Assignee's U.S. Pat. No. 5,675,876, entitled Casket With Pivoting Memorabilia Tray and hereby incorporated by reference herein.

Advances have therefore been made in the area of "personalization" of funeral products. However, there continues to be room for improvement in the area of personalization in the death care industry.

SUMMARY OF THE INVENTION

The present invention is a casket comprising a casket shell, a casket lid close able upon the shell and deployable structure, operably associated with either the shell or the lid, and integrally formed therewith, which, when deployed, defines a memorial surface adapted to have placed thereon items of memorialization for display. The deployable structure is so configured and arranged such that the items of memorialization must be removed therefrom when the structure is not deployed.

In one aspect, the deployable structure can be operably associated with said shell. In one embodiment of this aspect, the shell includes a roll-type shelf mounted therein at a foot end thereof, the shelf adapted to be deployed by grasping a head end thereof and pulling the shelf from a foot end of the shell toward a head end of the shell.

In another embodiment, the shell includes a pie-shaped shelf mounted in the shell, the shelf having first and second edges having first interconnected ends forming an apex and second ends interconnected by a third arcuate edge, the shelf pivoted to the shell at the apex of the shelf, the shelf adapted to be deployed by grasping a leading one of the first and second edges and pulling the shelf outwardly. The shelf can be mounted to the shell at an upper edge thereof, at a lower edge thereof, at an end thereof or at a side thereof.

In another embodiment, the shell includes a shelf pivotally mounted thereto at a forward side thereof and at an upper edge thereof, the shelf adapted to be deployed by first opening the lid, pivoting the shelf out of the shell and then closing the lid.

In another embodiment, the shell includes a shelf pivotally mounted thereto at a foot end thereof and at an upper edge thereof, the shelf adapted to be deployed by first opening the lid, pivoting the shelf out of the shell and then closing the lid.

In another embodiment, the shell includes a shelf slidably mounted therein, the shelf adapted to be deployed by pulling the shelf out of the shell. The shelf can be mounted in the shell at an upper edge thereof, at a lower edge thereof, at an end thereof or at a side thereof.

In another embodiment, the shell includes a shelf pivotally mounted to a foot end wall thereof along an upper edge of the shelf, the shelf adapted to be deployed by pivoting the shelf away from the foot end wall of the shell.

In another aspect, the deployable structure is operably associated with the lid. In one embodiment of this aspect, the lid includes a shadow box mounted to an underside thereof, the shadow box including a plurality of horizontal shelves upon which the items of memorialization can be placed and vertical divider panels defining, with the shelves, a plurality of three dimensional frames within which the items of memorialization can be displayed.

In another embodiment, the lid extends the full length of the shell and is readily detachable therefrom, and the lid includes a plurality of vertical divider panels which, when the lid is detached from the shell and positioned upright on an end thereof, forms an upstanding, freestanding set of shelves upon which the items of memorialization can be displayed.

In another embodiment, the lid includes a lower portion and an upper portion pivoted to the lower portion, the upper portion adapted to be deployed by pivoting the upper portion away from the lower portion. The upper portion can be pivoted to the lower portion at a foot end edge thereof, at a forward side edge thereof or at a rearward side edge thereof.

In another embodiment, the casket includes a head end lid and a foot end lid, and the head end lid includes a shelf slidably and pivotally mounted therein, the shelf adapted to be deployed by first opening the head end lid, sliding the shelf out of the lid and then pivoting the shelf downwardly relative to the lid.

In another embodiment, the casket includes four posts mounted to an upper surface thereof, and a shelf mounted atop the posts.

In another embodiment, the lid includes a shelf pivotally mounted to an underneath side of the lid along a lower edge of the shelf, the shelf adapted to be deployed by opening the foot end lid and pivoting the shelf downwardly relative to the lid.

In another embodiment, the lid includes an end panel and the end panel includes a shelf pivotally mounted to the end panel along a lower edge of the shelf, the shelf adapted to be deployed by pivoting the shelf away from the end panel. The shelf can include first, second and third sections, the first section pivoted to the end panel, the second and third sections pivoted to the first section at opposite side edges of the first section, the shelf adapted to be deployed by pivoting the first section away from the end panel and by pivoting the second and third sections relative to the first section to thereby form a substantially planar shelf out of the first, second and third sections.

One advantage of the present invention is that, unlike the shelf of the Assignee's U.S. Pat. No. 4,457,054 which must be installed into the dish assembly each time it is used and then removed from the dish assembly before the head end lid is closed, the various memorial surface providing structures of the present invention are integral with either the lid or the shell, as the case may be, thereby preventing possible misplacement etc. of the shelf of U.S. Pat. No. 4,457,054.

Another advantage of the present invention is that, unlike the drawer and tray of the Assignee's U.S. Pat. Nos. 5,611,124 and 5,727,291, the various memorial surface providing structures of the present invention are focused on display of the items of memorialization, and not storage, and therefore do not require or otherwise take up the volume of the drawer and tray of U.S. Pat. Nos. 5,611,124 and 5,727,291.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
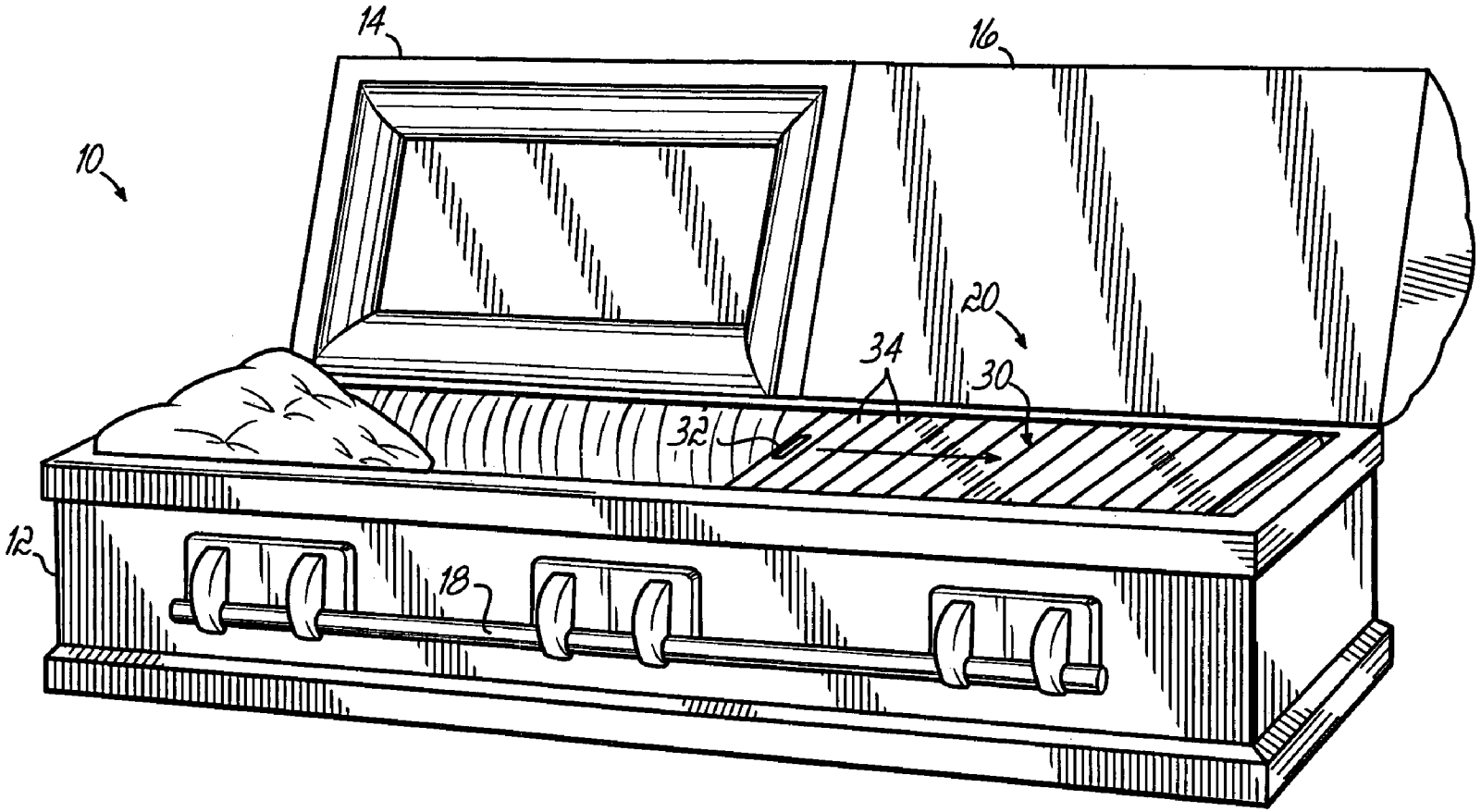
FIG. 1 is a perspective view of one embodiment of the present invention.
Figure 2A:
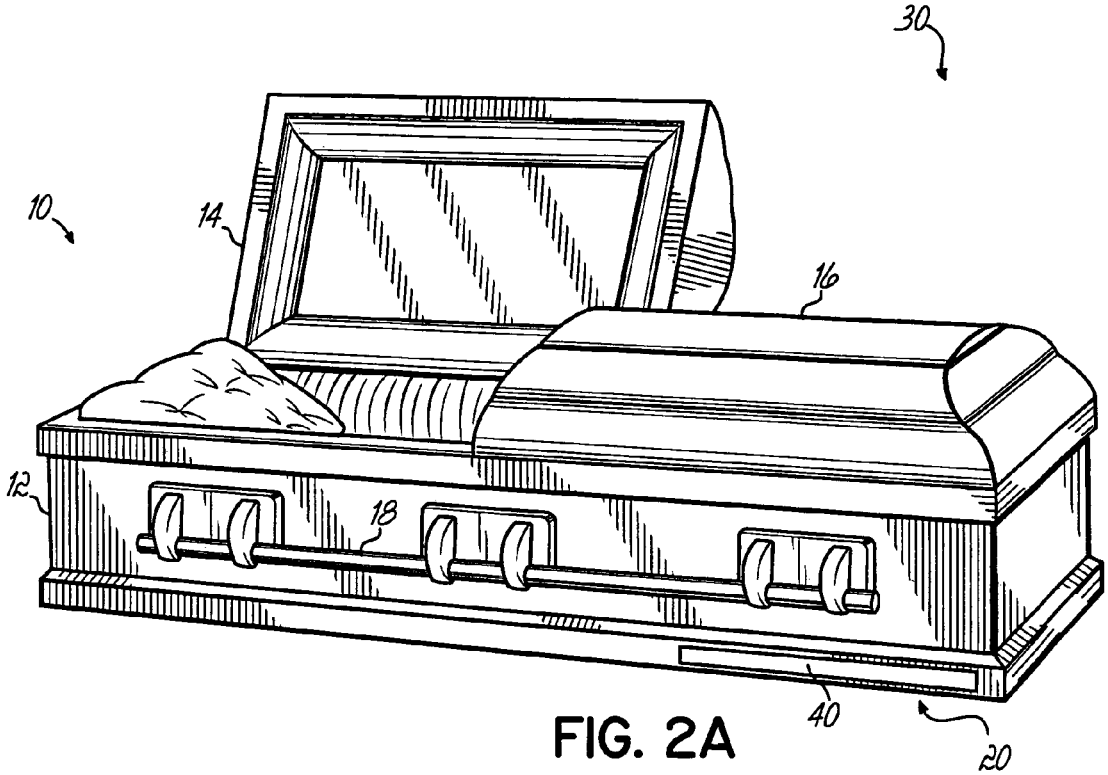
FIGS. 2A and 2B are perspective views of another embodiment.
Figure 2B:
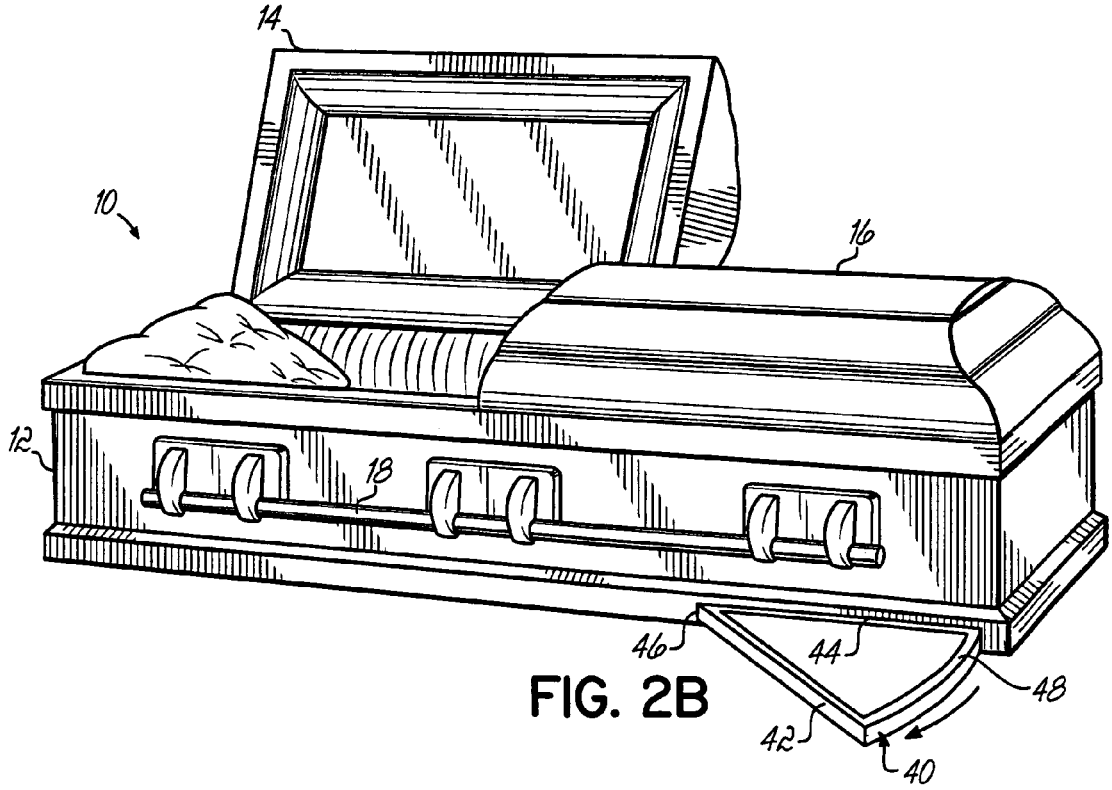
Figure 3A:
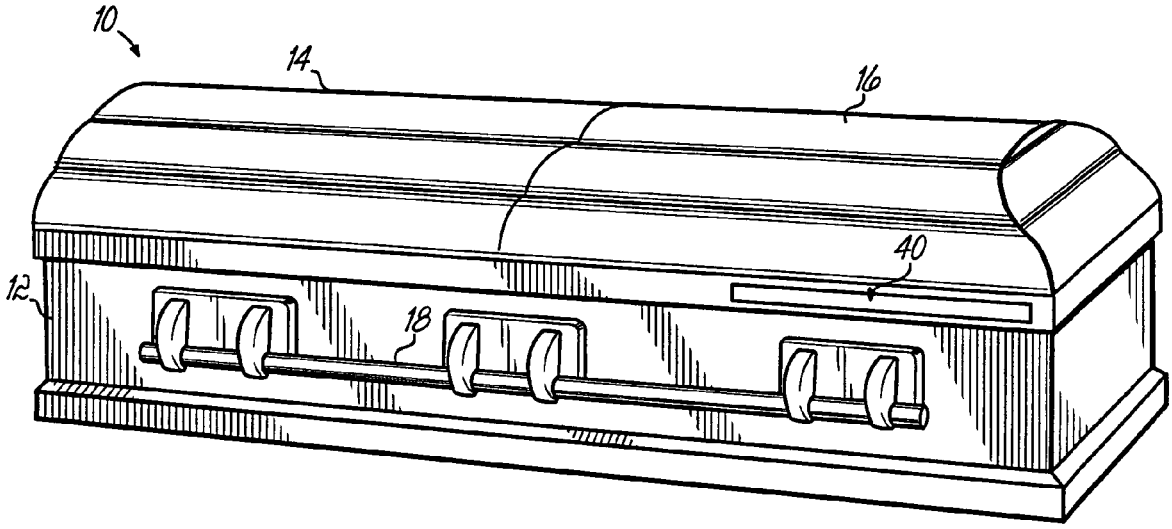
FIGS. 3A and 3B are perspective views of another embodiment.
Figure 3B:
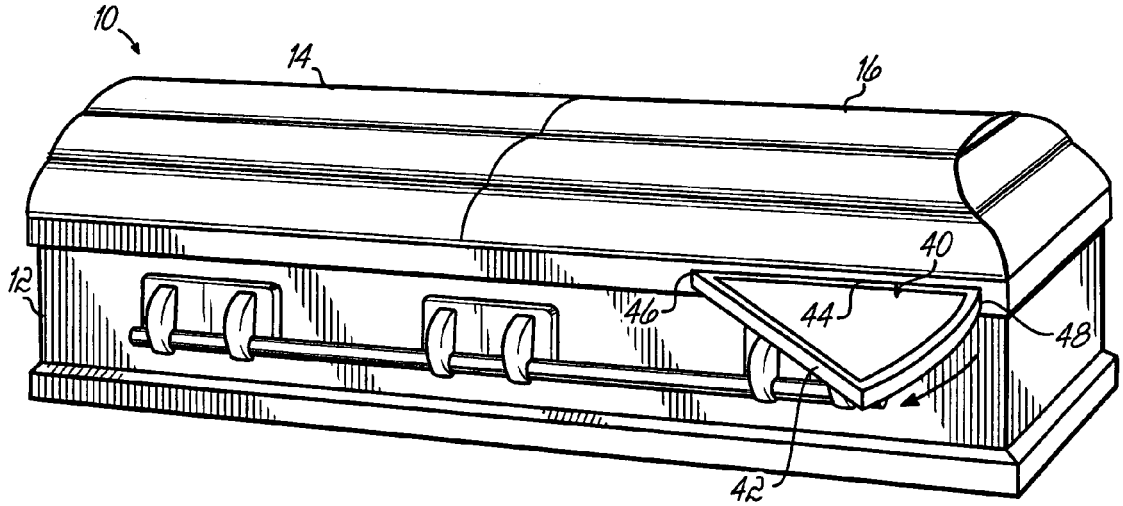

Referring first to FIG. 1, there is illustrated a casket 10 according to the present invention. Casket 10 includes a shell 12, a head end lid 14, a foot end lid 16 and handling structure 18. Casket 10 further includes deployable structure 20 which, when deployed, defines a memorial surface adapted to have placed thereon items of memorialization. Deployable structure 20 can either be operably associated with the shell 12 or the lid (14 and/or 16), and further is integrally formed therewith, i.e. is not a separate item but rather is constructed as a part of either the shell or lid as the case may be. As illustrated in FIG. 1, deployable structure 20 is operably associated with the shell 12, as are the other embodiments illustrated in FIGS. 2-8; the embodiments illustrated in FIGS. 9-17C have deployable structure 20 operably associated with the lid, either head end lid 14, foot end lid 16 or one-piece, full length lid 22 (FIG. 10). Furthermore, those embodiments illustrated and/or described as being associated with the head end lid 14 could just as well function in association with foot end lid 16 and vice versa, and those embodiments illustrated and/or described as being associated with either a head end lid 14 or foot end lid 16 could just as well function in association with a full length lid 22, unless otherwise indicated. Accordingly, the claims shall embrace all such variations.

Referring still to FIG. 1 (and to all the other FIGS. that matter), structure 20 is configured and arranged such that items of memorialization must be removed therefrom when the structure is not deployed. In other words, structure 20 is intended to define merely a two-dimensional surface atop which the items of memorialization can be displayed, rather than a three-dimensional volume in which the items can be stored as well as displayed. To that end, the structure 20 of FIG. 1 takes the form of a roll-type shelf 30 mounted in the shell 12 at a foot end thereof. To deploy the shelf 30, one grasps the head end 32 of the shelf 30 and pulls the shelf 30 from the foot end of the shell 12 toward the head end of the shell 12. To move the shelf 30 into its undeployed position, the shelf 30 is moved in the opposite direction toward the foot end of the shell 12. The individual slats 34 permit the roll-type shelf to roll downwardly along the inside surface of foot end wall of the shell 12 and then forwardly toward the head end wall of the shell 12, and vice versa.

Referring now to FIGS. 2A, 2B, 3A and 3B, structure 20 takes the form of a pie-shaped shelf 40 mounted in the shell 12. Shelf 40 has first and second edges 42, 44 having first interconnected ends forming an apex 46, and second ends interconnected by a third arcuate edge 48. The shelf 40 is pivoted to the shell 12 at the apex 46, and is deployed by grasping the leading edge (edge 42 as illustrated) and pulling the shelf outwardly. The shelf 40 can be mounted to the shell 12 at the lower edge thereof (FIGS. 2A and 2B), the upper edge thereof (FIGS. 3A and 3B), the end thereof (FIGS. 2A, 2B, 3A and 3B) and/or the side thereof (FIGS. 2A, 2B, 3A and 3B).

Figure 4A:
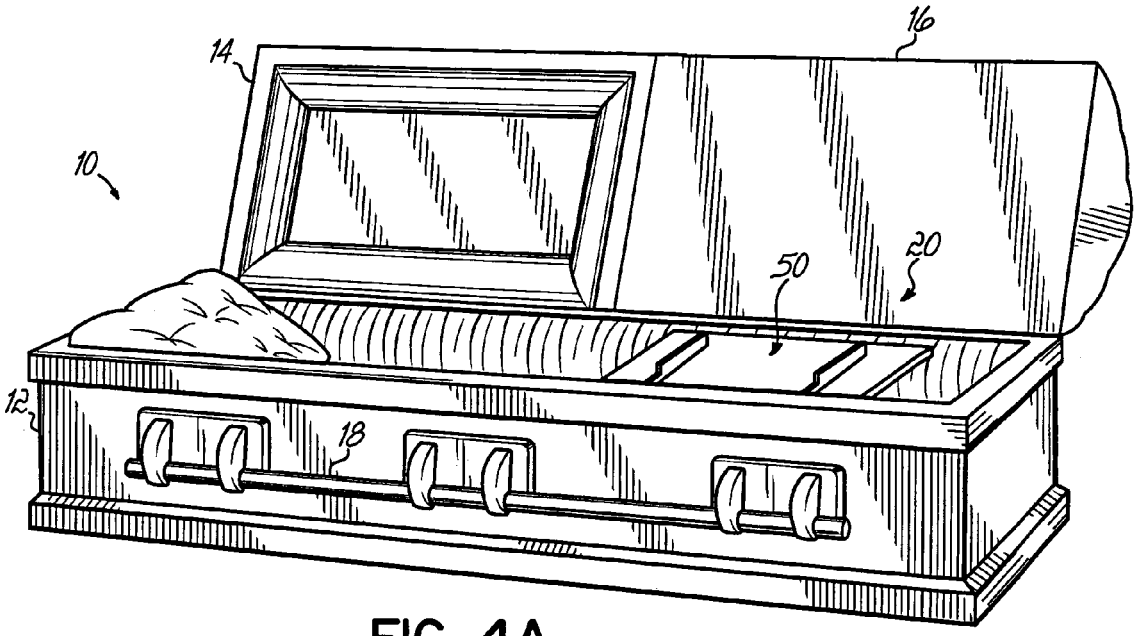
FIGS. 4A and 4B are perspective views of another embodiment.
Figure 4B:
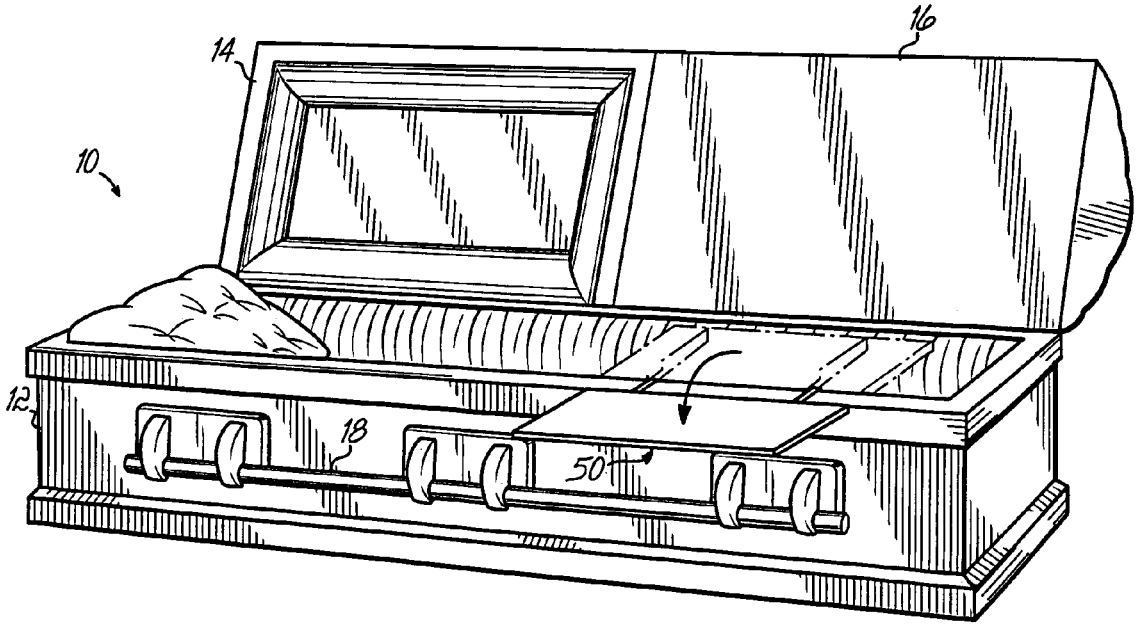

Referring now to FIGS. 4A and 4B, structure 20 takes the form of a shelf 50 pivotally mounted to the shell 12 at a forward side thereof and at an upper edge thereof. The shelf 50 is deployed by first opening (as illustrated) the foot end lid 16, pivoting the shelf 50 out of the shell 12 and then closing the lid 16.

Figure 5A:
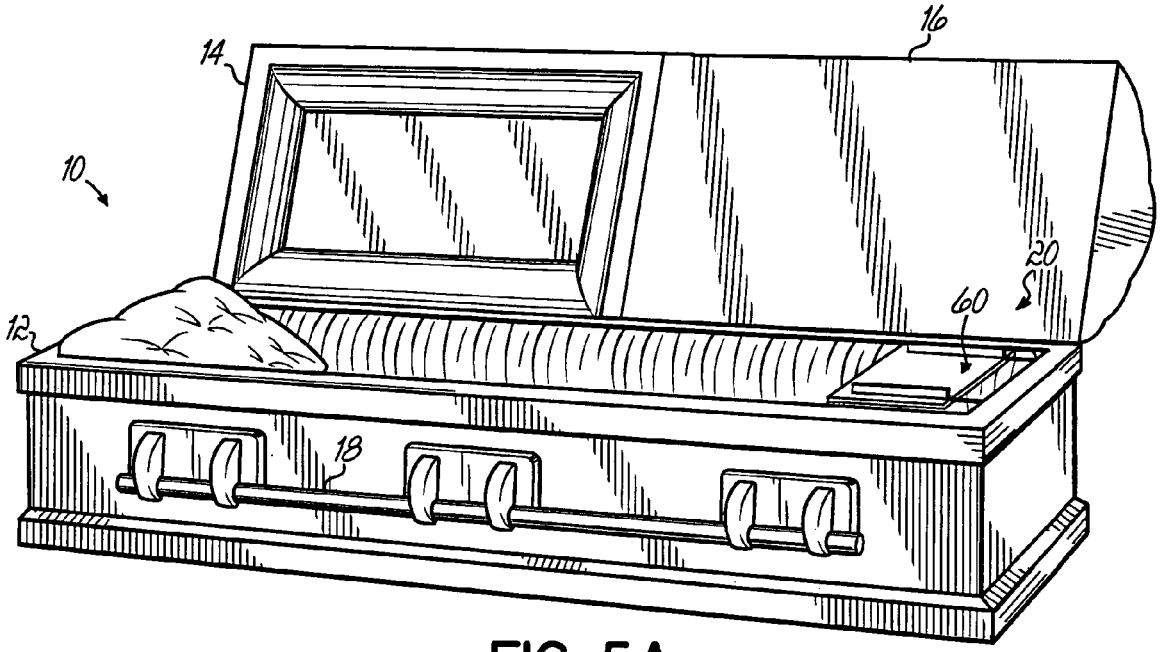
FIGS. 5A-5C are perspective views of another embodiment.
Figure 5B:
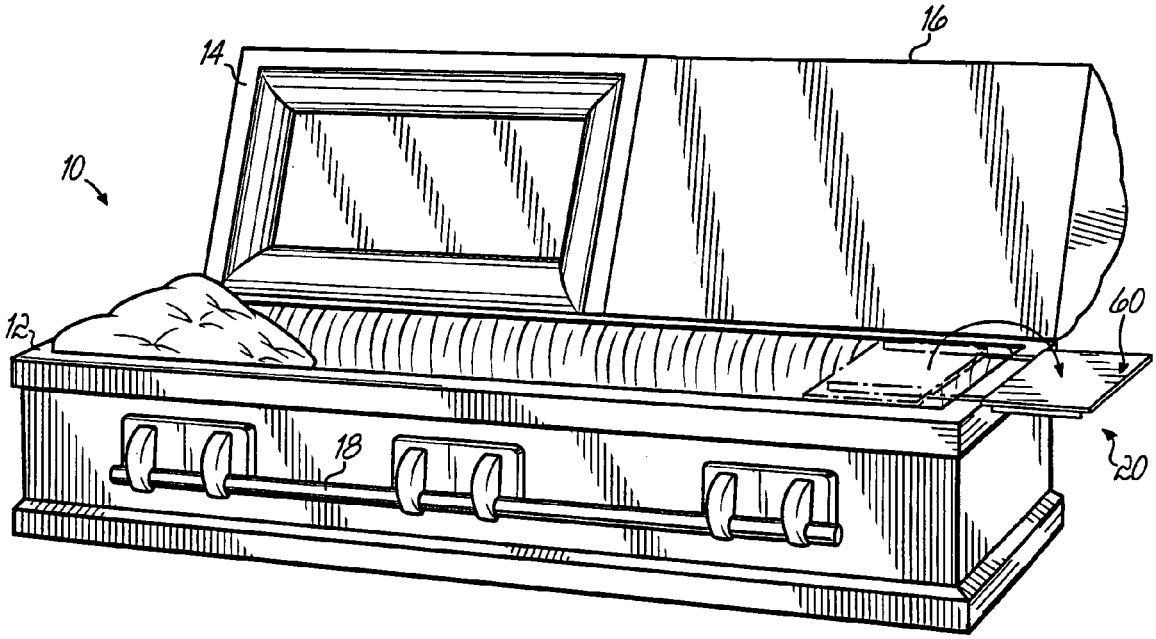
Figure 5C:
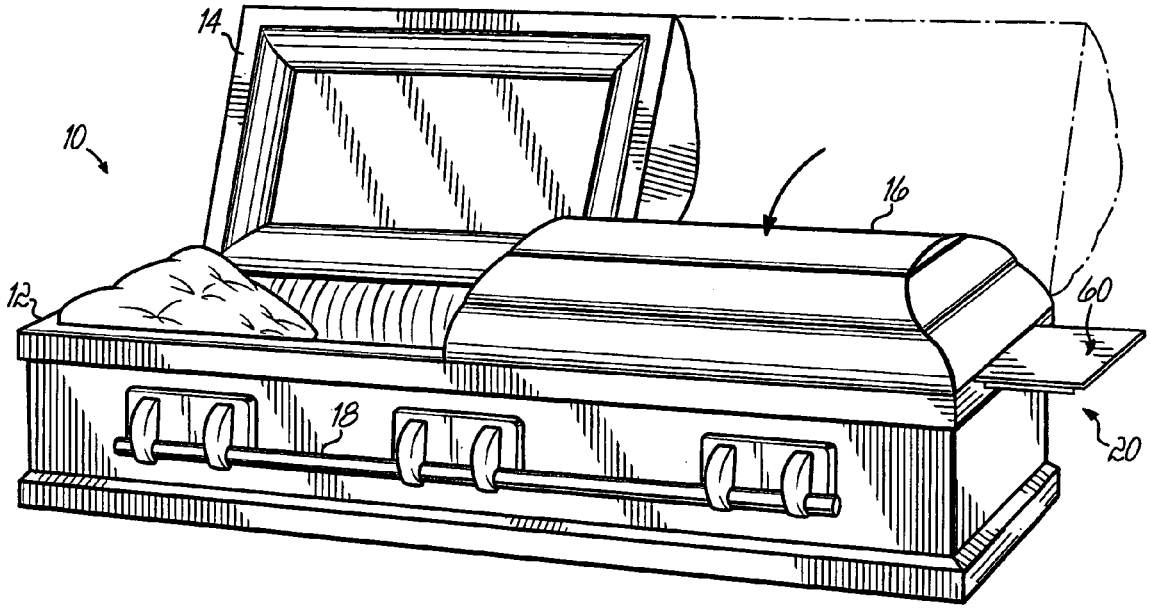

Referring now to FIGS. 5A-5C, structure 20 takes the form of a shelf 60 pivotally mounted to the shell 12 at a foot end thereof and at an upper edge thereof. The shelf 60 is deployed by first opening (as illustrated) the foot end lid 16, pivoting the shelf 60 out of the shell 12 and then closing the lid 16.

Figure 6A:
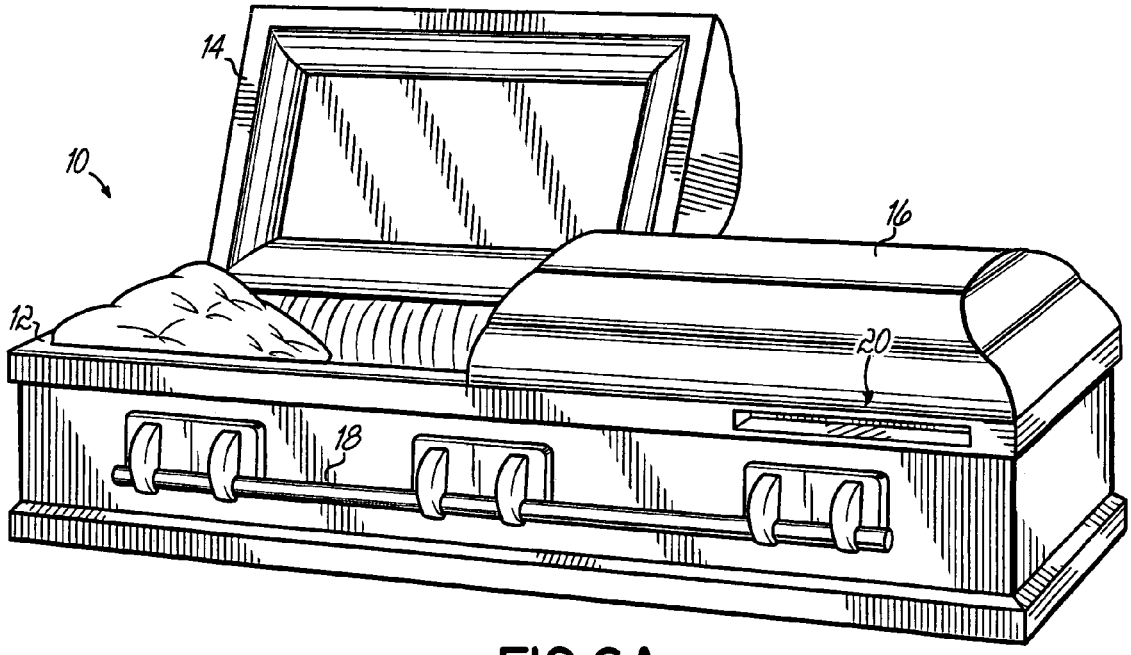
FIGS. 6A and 6B are perspective views of another embodiment.
Figure 6B:
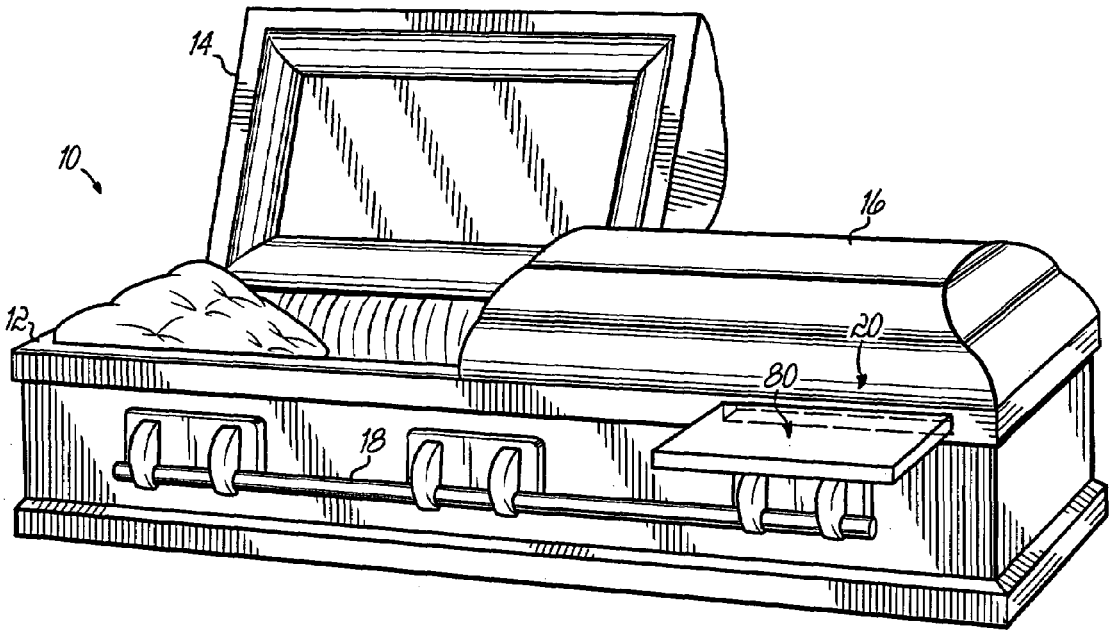
Figure 7:
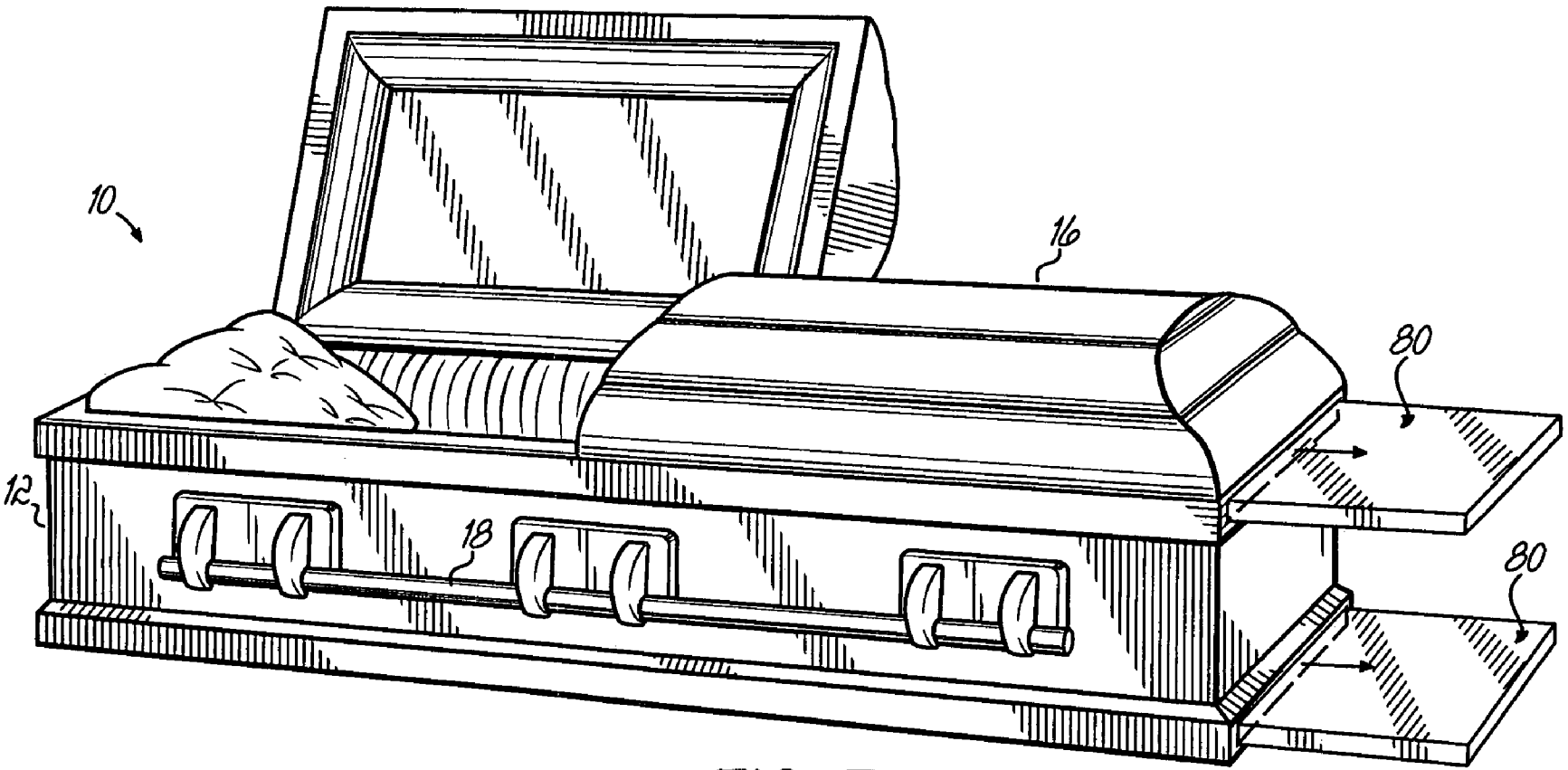
FIG. 7 is a perspective view of another embodiment.

Referring to FIGS. 6A, 6B and 7, structure 20 takes the form of a shelf 70 slidably mounted in the shell 12, the shelf 70 deployed by pulling the shelf 70 out of the shell 12. The shelf 70 can be mounted in the shell 12 at an upper edge thereof (FIGS. 6A, 6B and 7), the lower edge thereof (FIG. 7), the side thereof (FIGS. 6A and 6B) and/or the end thereof (FIG. 7).

Figure 8:
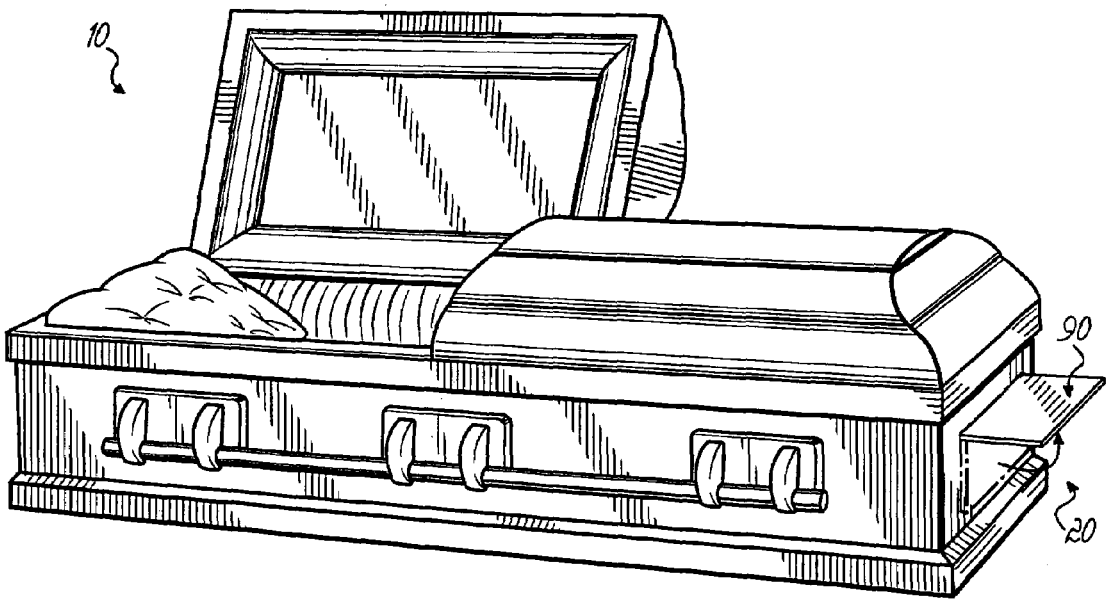
FIG. 8 is a perspective view of another embodiment.

Referring to FIG. 8, structure 20 takes the form of a shelf 80 pivotally mounted to a foot end wall of the shell 12 along an upper edge of the shelf 80. The shelf 80 is deployed by pivoting the shelf 80 away from the foot end wall.

Figure 9:
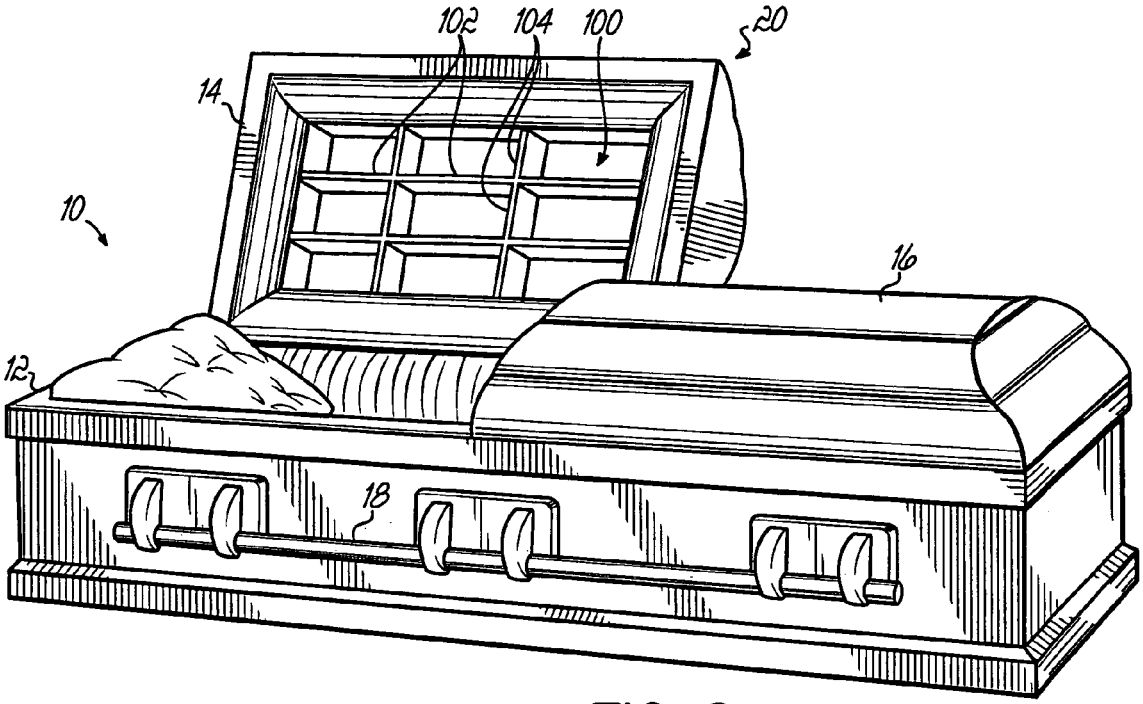
FIG. 9 is a perspective view of another embodiment.
Figure 10:
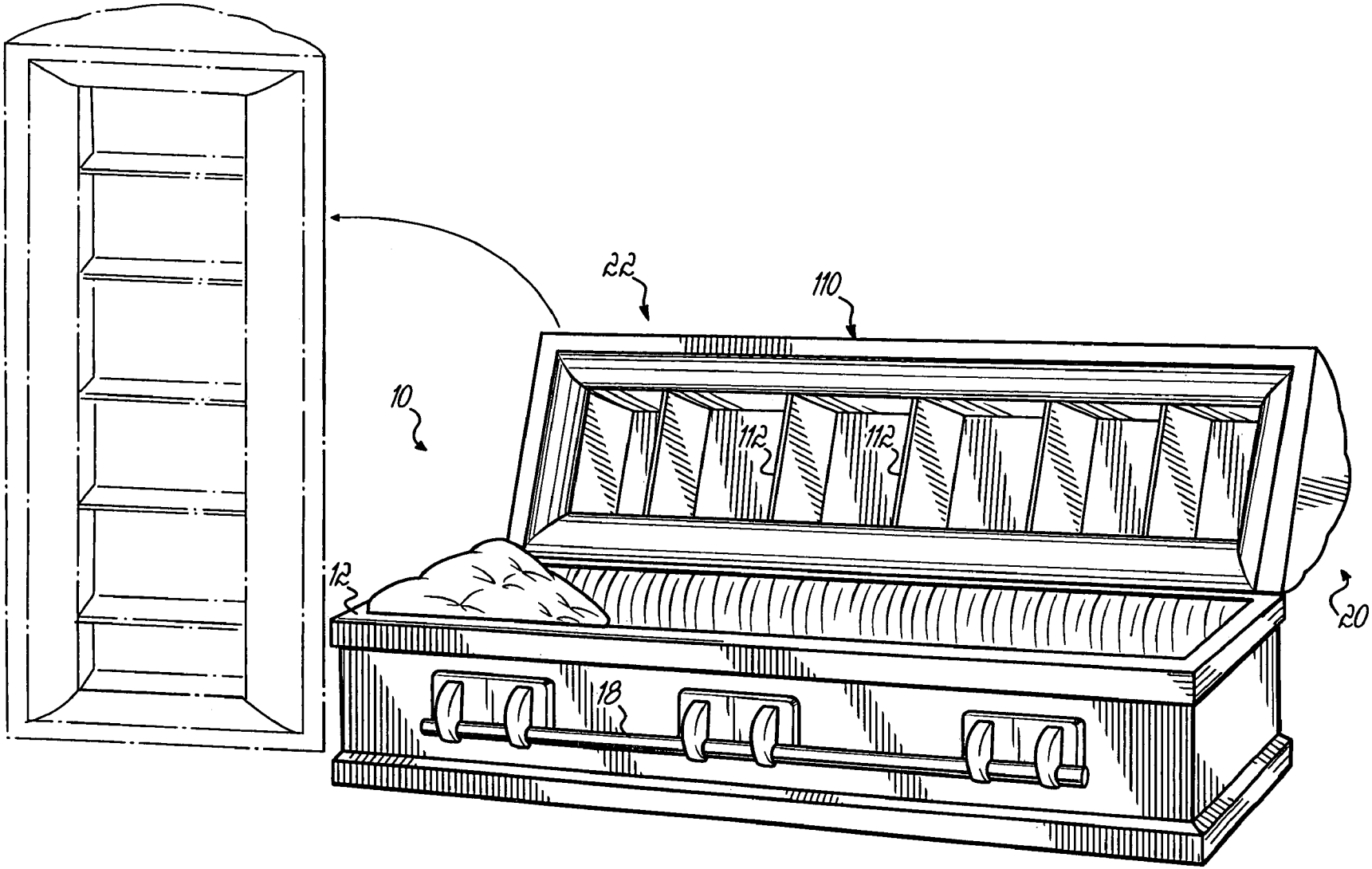
FIG. 10 is a perspective view of another embodiment.

Referring now to FIG. 9, structure 20 takes the form of a shadow box 90 mounted to an underside of head end lid 14. Shadow box 90 has a plurality of horizontal shelves 92 upon which the items of memorialization can be placed and a plurality of vertical divider panels 94 defining, with the shelves 92, a plurality of three dimensional frames within which the items of memorialization can be displayed. Referring now to FIG. 10, casket 10 has a full length lid 22 which is readily detachable from the shell 12. When detached from shell 12, and stood upright on its end, lid 22 forms an upstanding, freestanding set of shelves upon which the items of memorialization can be displayed. To that end, the lid 22 has a plurality of vertical (when attached to the shell 12) divider panels, which form shelves when the lid 22 is stood on its end.

Figure 11A:
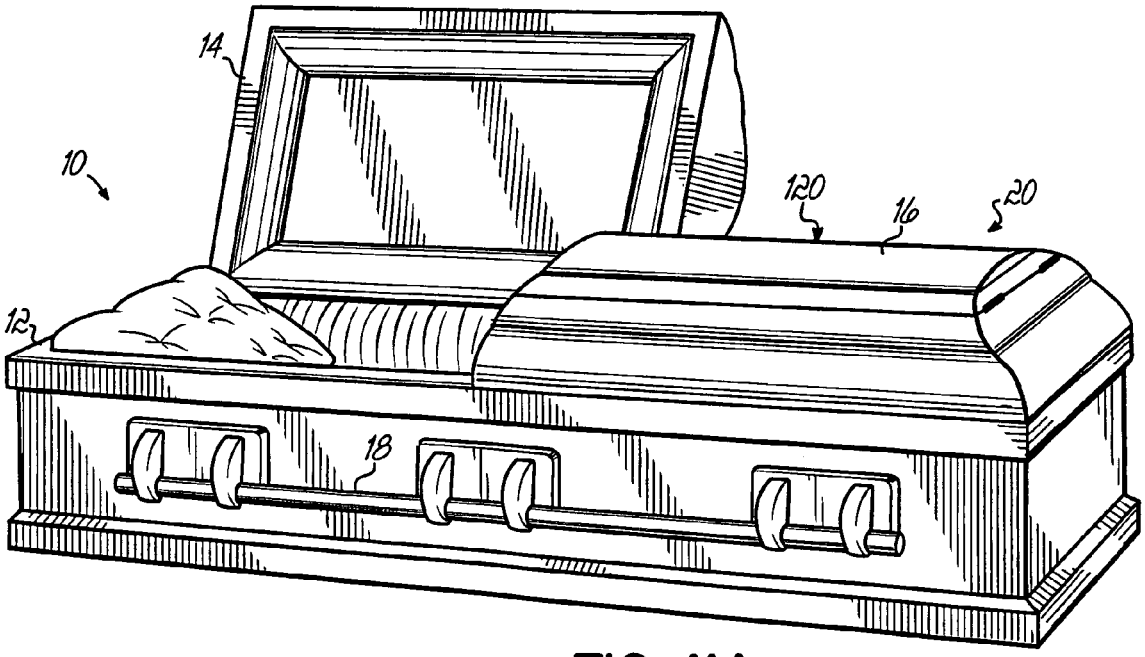
FIGS. 11A and 11B are perspective views of another embodiment.
Figure 11B:
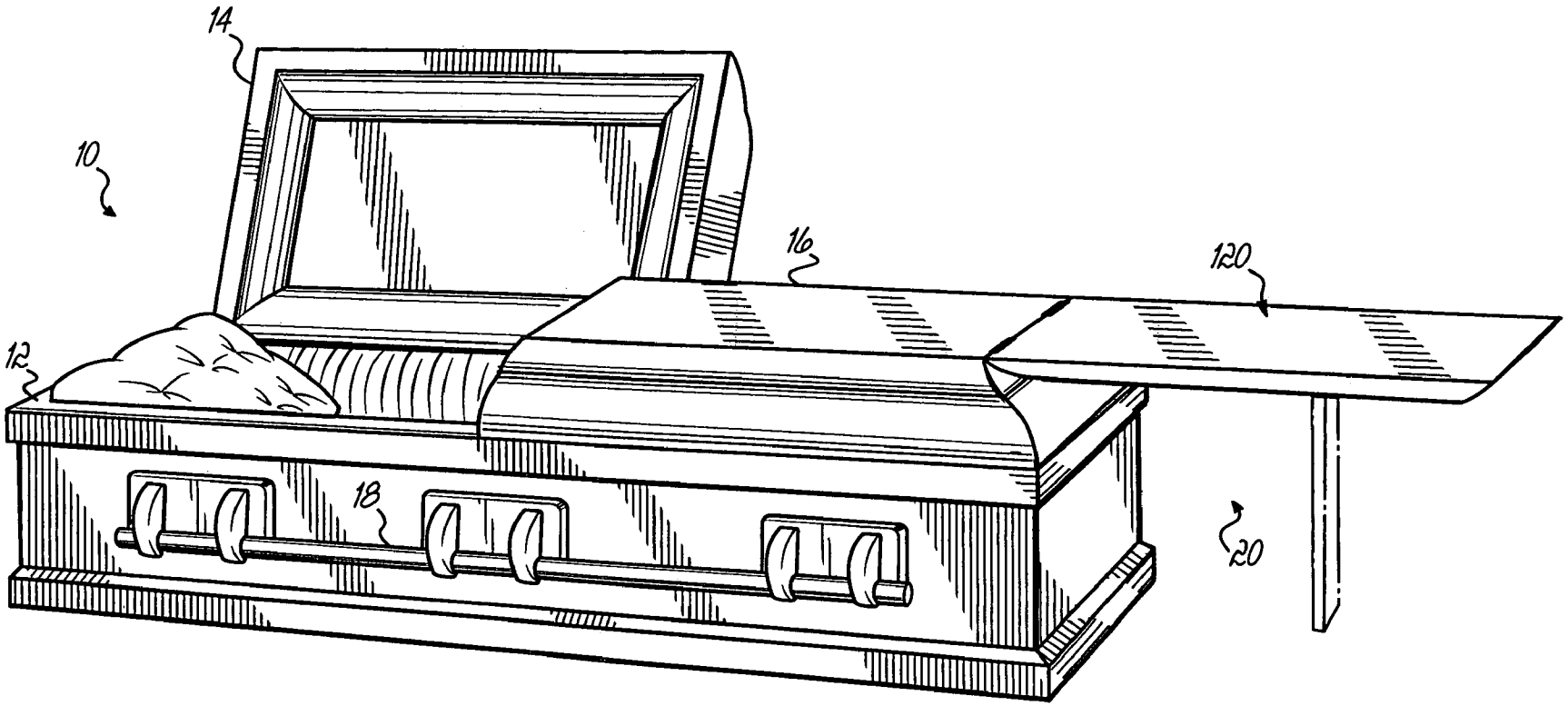

Referring to FIGS. 11A and 11B, foot end lid 16 includes an upper portion forming a shelf 100 pivoted to a lower portion of the lid 16 at a foot end edge thereof. Shelf 100 is deployed by pivoting it relative to the lower portion of the lid 16.

Figure 12A:
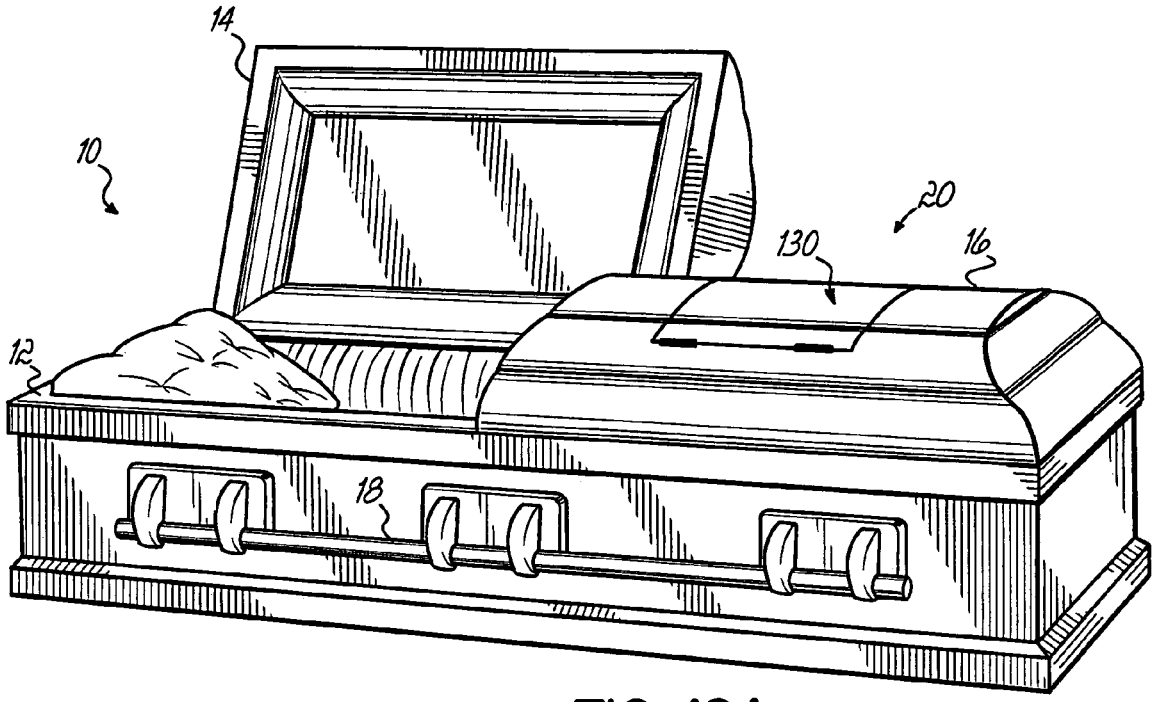
FIGS. 12A and 12B are perspective views of another embodiment.
Figure 12B:
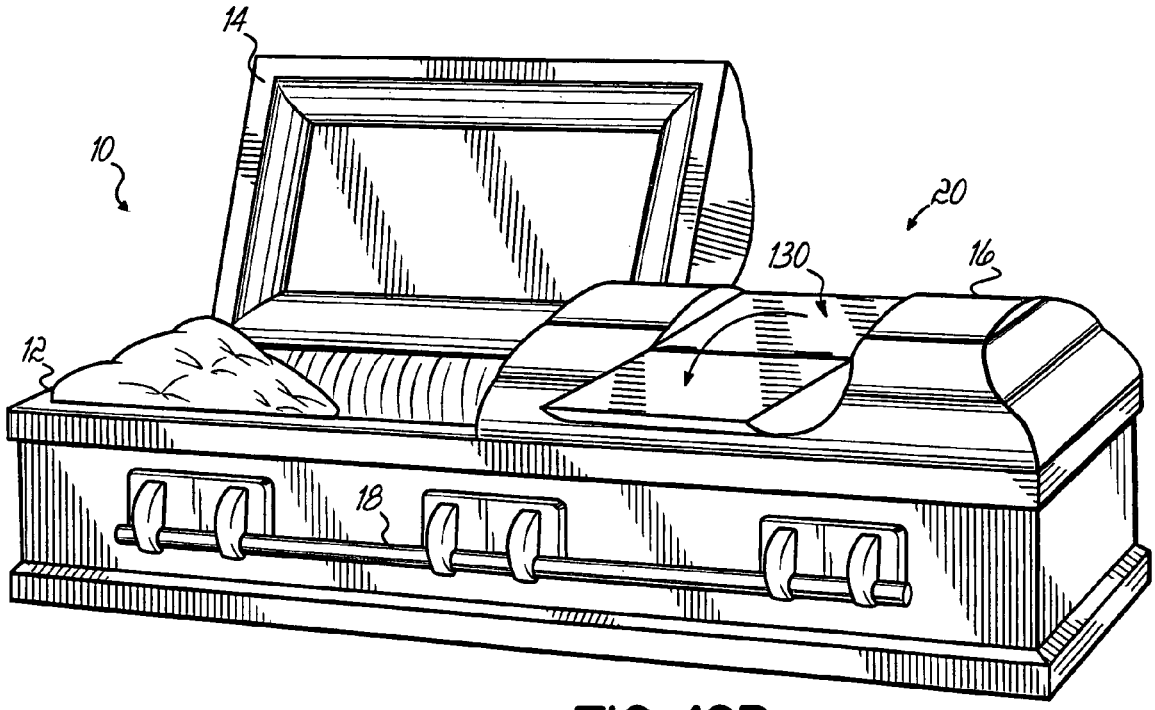

Referring to FIGS. 12A and 12B, foot end lid 16 includes an upper portion forming a shelf 110 pivoted to a lower portion of the lid 16 at a forward side edge thereof. Shelf 110 is deployed by pivoting it relative to the lower portion of the lid 16.

Figure 13:
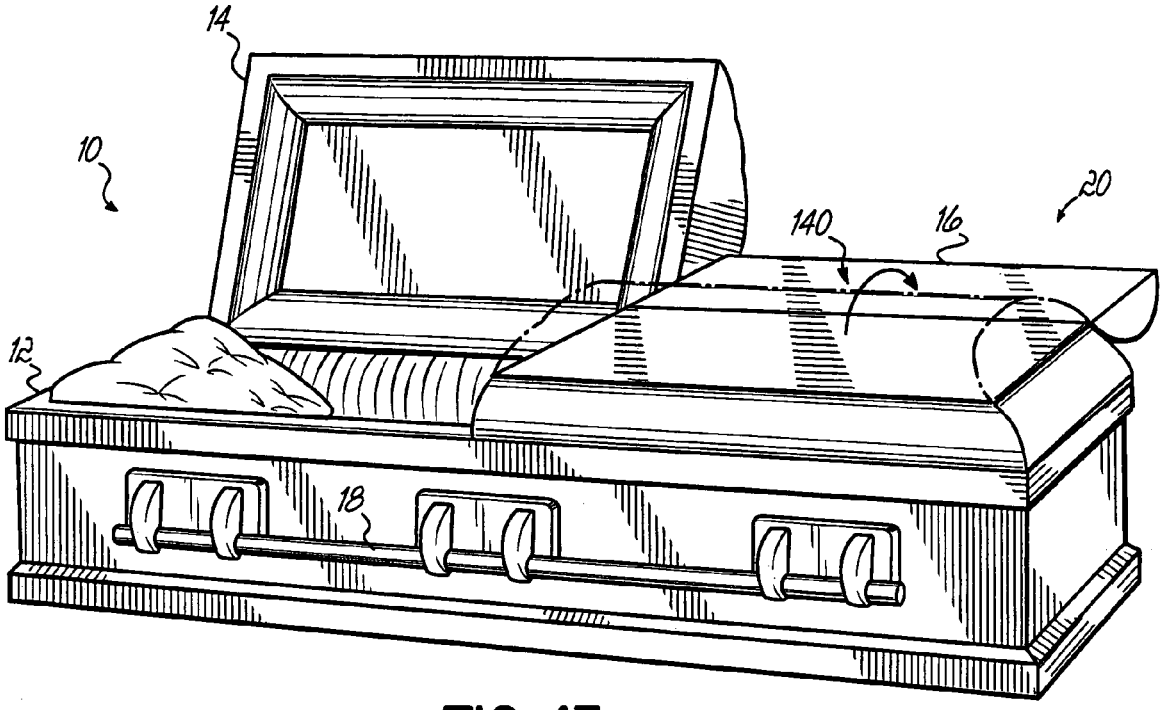
FIG. 13 is a perspective view of another embodiment.

Referring to FIG. 13, foot end lid 16 includes an upper portion forming a shelf 120 pivoted to a lower portion of the lid 16 at a rearward side thereof. Shelf 120 is deployed by pivoting it relative to the lower portion of the lid 16.

Figure 14A:
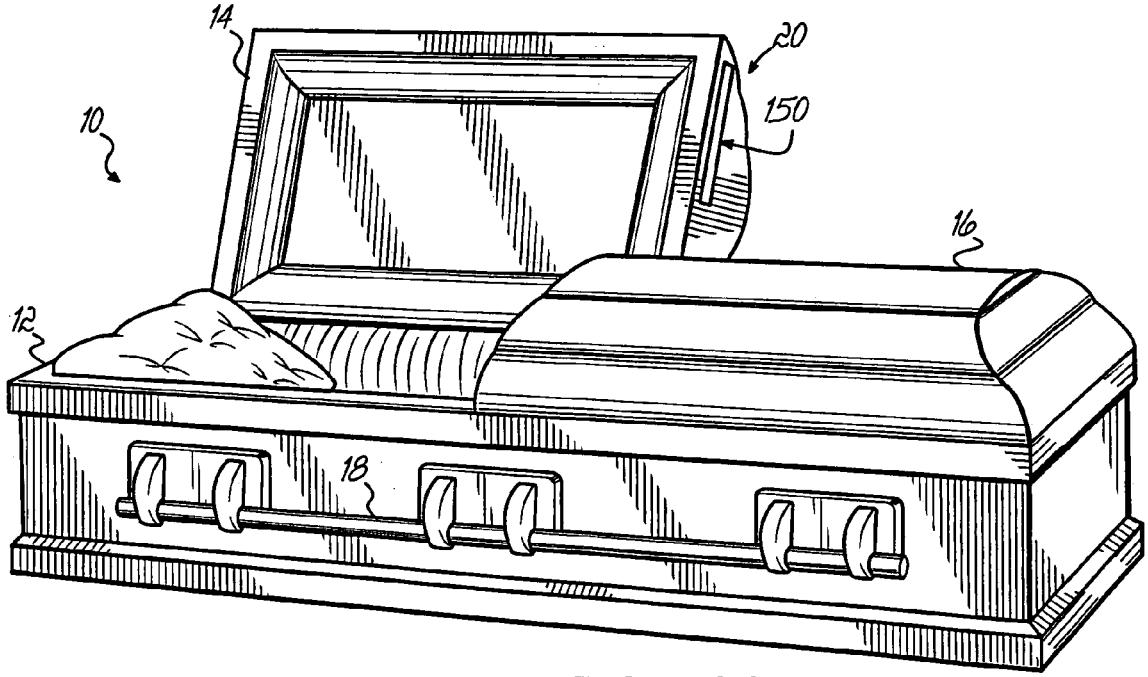
FIGS. 14A and 14B are perspective views of another embodiment.
Figure 14B:
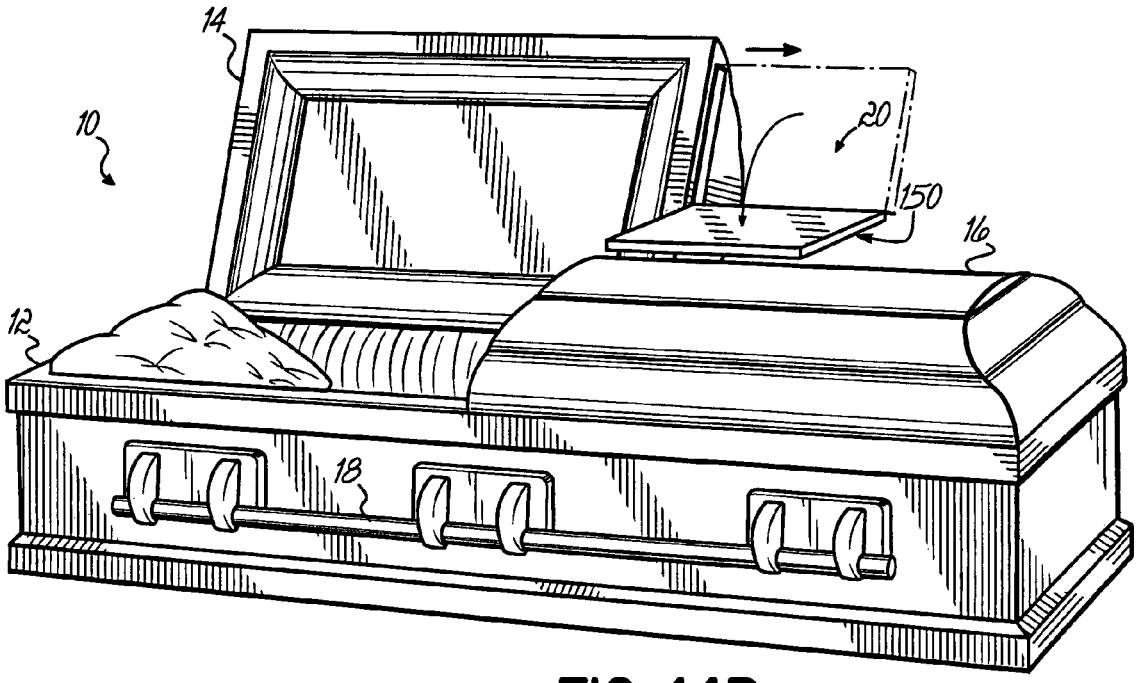

Referring to FIGS. 14A and 14B, head end lid 14 includes a shelf 130 which is both slidably and pivotally mounted therein. Shelf 130 is deployed by first opening head end lid 14, sliding the shelf 130 out of the lid 14 and then pivoting the shelf 130 downwardly relative to the lid 14.

Figure 15A:
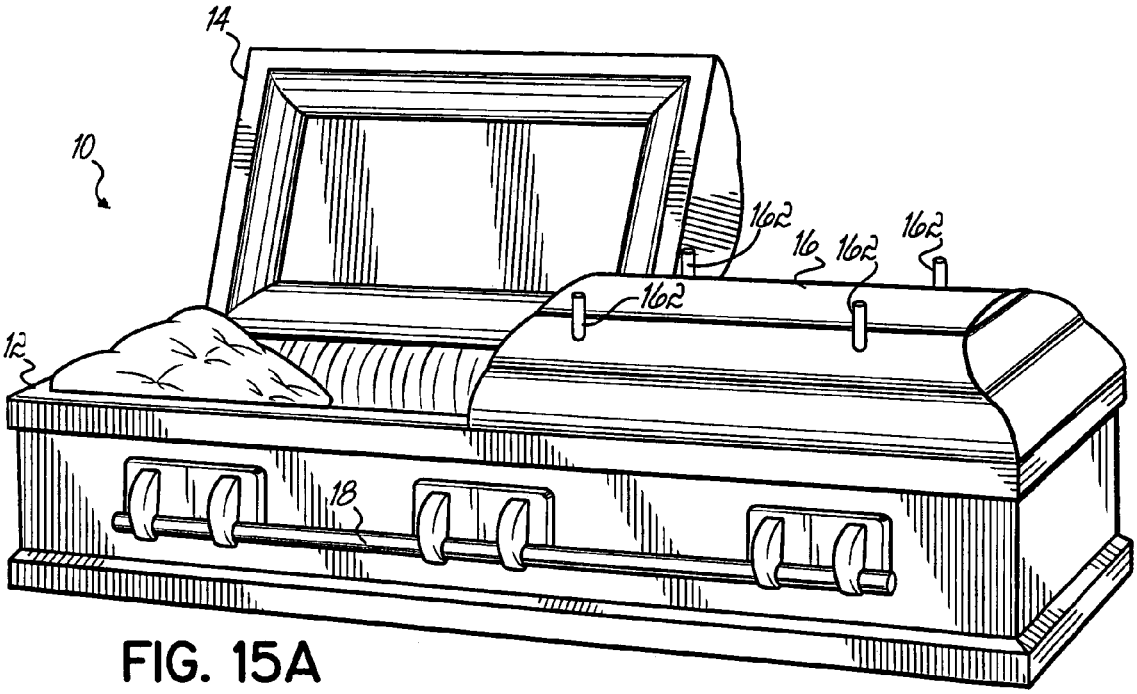
FIGS. 15A and 15B are perspective views of another embodiment.
Figure 15B:
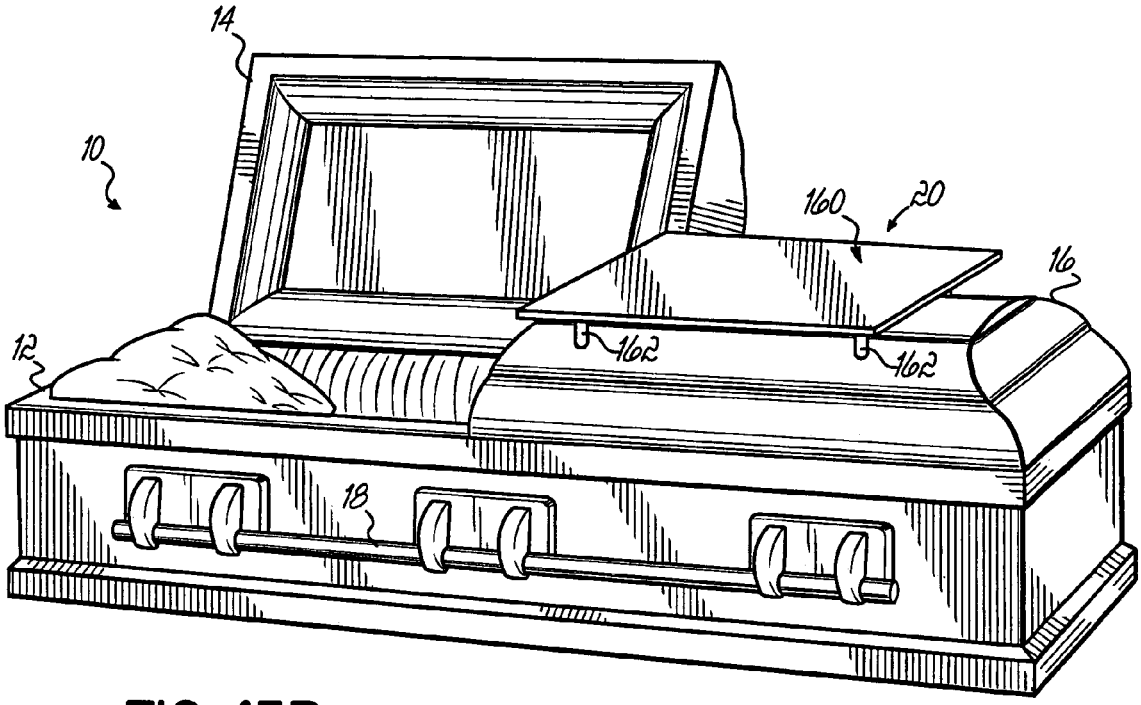

Referring to FIGS. 15A and 15B, foot end lid 16 includes a shelf 140 mounted atop four posts 142, themselves mounted to an upper surface of lid 16.

Figure 16:
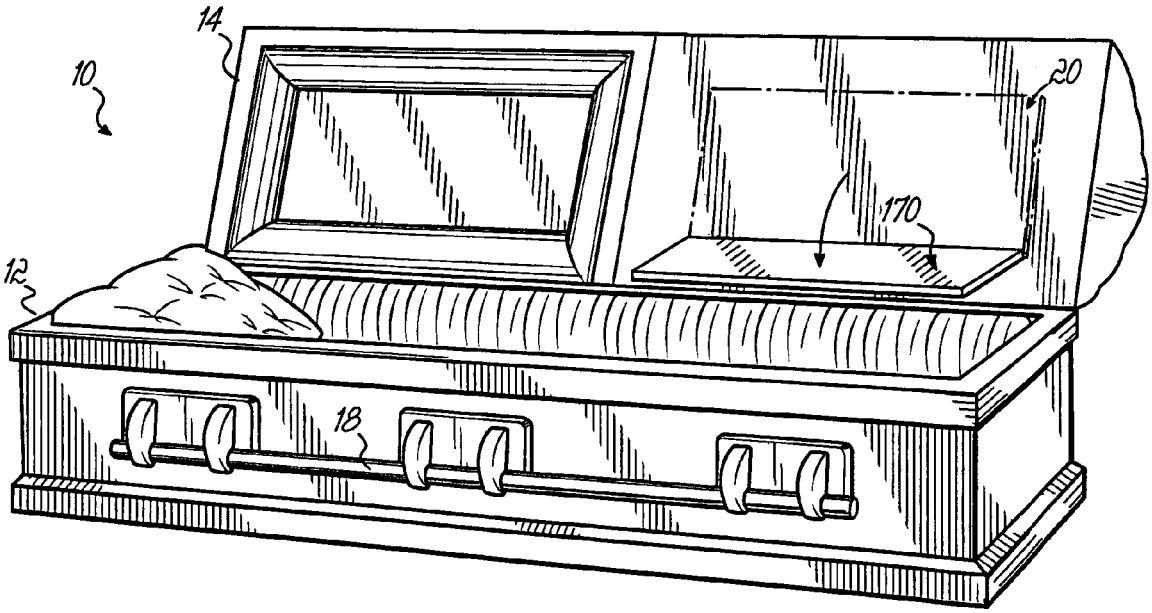
FIG. 16 is a perspective view of another embodiment.

Referring to FIG. 16, foot end lid 16 (as illustrated) includes a shelf 150 pivotally mounted to an underneath side of the lid 16 along a lower edge of the shelf 150. Shelf 150 is deployed by opening the foot end lid 16 and pivoting the shelf 150 downwardly relative to the lid 16.

Figure 17A:
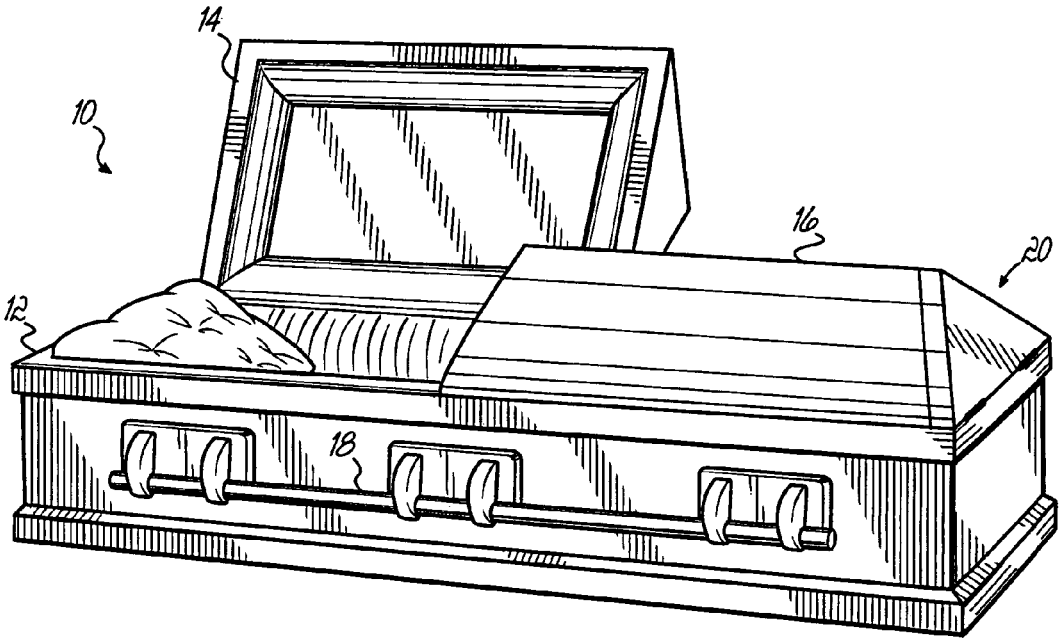
FIG. 17A-17C are perspective views of another embodiment.
Figure 17B:
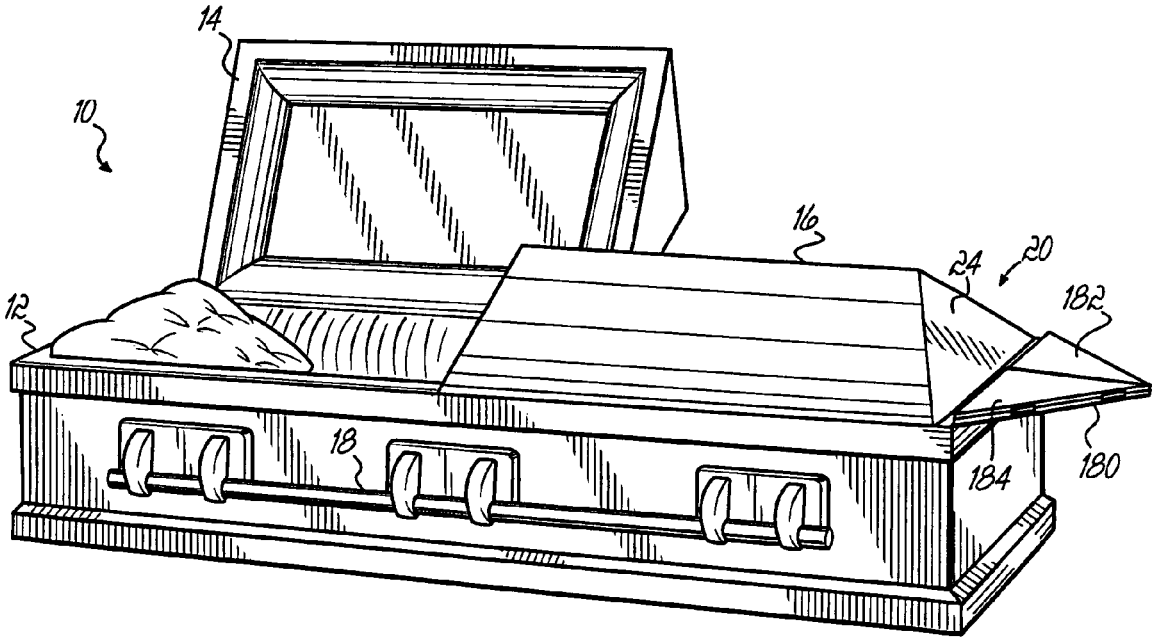
Figure 17C:
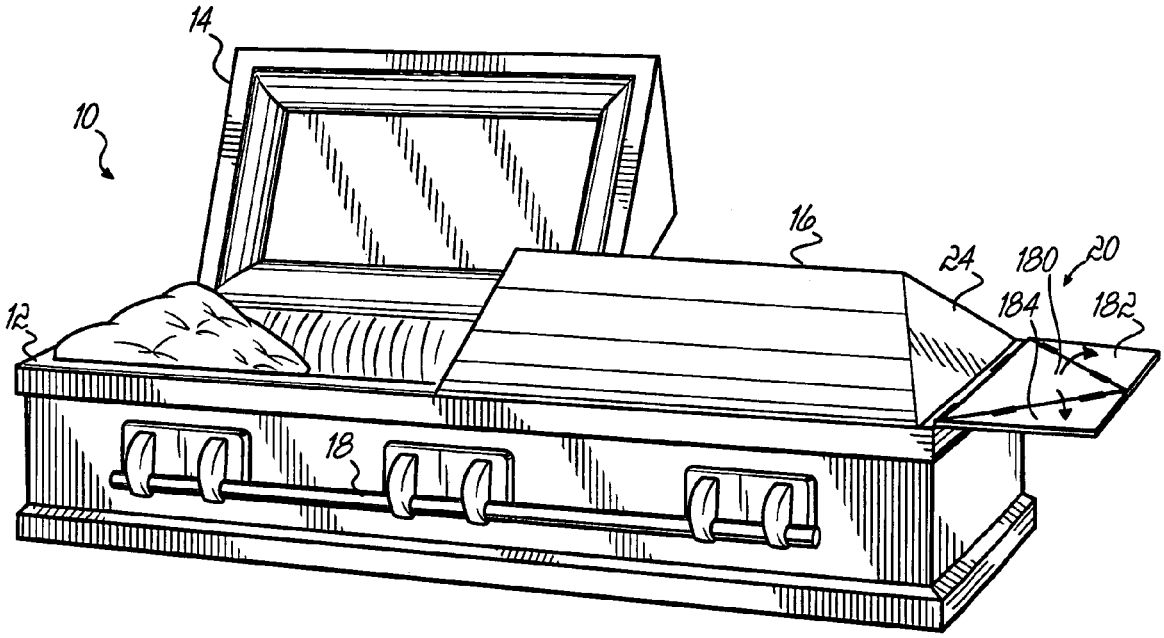

Finally, referring to FIGS. 17A-17C, foot end lid 16 includes an end panel 24 and a shelf 160 pivotally mounted to end panel 24 along a lower edge of the shelf 160. The shelf 160 is adapted to be deployed by pivoting the shelf 160 away from the end panel 24. The shelf can comprise three sections, first section 160 pivoted to end panel 24, and second and third sections 162, 164 pivoted to the first section 160 at opposite side edges of the first section 160. In that case the shelf is deployed by pivoting the first section 160 away from the end panel 24 and by pivoting the second and third sections 162, 164 relative to the first section 160 to thereby form a substantially planar shelf out of the first, second and third sections.

Those skilled in the art will recognize that various hinges, brackets, braces etc. not specifically shown in the drawings but well known to those skilled in the art can be utilized with the various embodiments of the present invention to pivotally connect the various components, insure that the various memorial surfaces are substantially horizontal, etc. In addition, those skilled in the art will readily recognize numerous adaptations and modifications which can be made to the present invention which will result in an improved memorialization casket, yet all of which will fall within the spirit and scope of the present invention as defined in the following claims. Accordingly, the invention is to be limited only by the scope of the following claims and their equivalents.

What is claimed is:

1. A casket comprising:

a casket shell;

a casket lid closable upon said shell; and deployable structure, operably associated with said shell, and integrally formed therewith, which, when deployed, defines a memorial surface adapted to have placed thereon items of memorialization for display, said deployable structure configured and arranged for display only of said items and not for storage of said items; said structure being so configured and arranged such that the items of memorialization must be removed therefrom when said structure is not deployed; and wherein said deployable structure includes a shelf pivotally mounted to said shell at a forward side thereof and at an upper edge thereof, said shelf adapted to be deployed by first opening said lid, pivoting said shelf out of said shell thereby changing an orientation of said memorial surface of said shelf from downwardly facing to upwardly facing, and then closing said lid.

2. A casket comprising:

a casket shell;

a casket lid closable upon said shell; and deployable structure, operably associated with said shell, and integrally formed therewith, which, when deployed, defines a memorial surface adapted to have placed thereon items of memorialization for display, said deployable structure configured and arranged for display only of said items and not for storage of said items; said structure being so configured and arranged such that the items of memorialization must be removed therefrom when said structure is not deployed; and wherein said deployable structure includes a shelf pivotally mounted to said shell at a foot end thereof and at an upper edge thereof, said shelf adapted to be deployed by first opening said lid, pivoting said shelf out of said shell thereby changing an orientation of said memorial surface of said shelf from downwardly facing to upwardly facing, and then closing said lid.

3. A casket comprising:

a casket shell;

a casket lid closable upon said shell; and deployable structure, operably associated with said shell, and integrally formed therewith, which, when deployed, defines a memorial surface adapted to have placed thereon items of memorialization for display, said deployable structure configured and arranged for display only of said items and not for storage of said items; said structure being so configured and arranged such that the items of memorialization must be removed therefrom when said structure is not deployed; and wherein said deployable structure includes a shelf pivotally mounted to a foot end wall of said shell along an upper edge thereof, said shelf adapted to be deployed by pivoting said shelf away from said foot end wall of said shell thereby changing an orientation of said memorial surface of said shelf from downwardly facing to upwardly facing.

* * * * *